US005087033A

United States Patent [19]

Tagney et al.

[11] Patent Number: 5,087,033

[45] Date of Patent: Feb. 11, 1992

[54] JOGGING GENERATOR

[76] Inventors: Lee Tagney, 1626 N. Wilcox Ave. Box 220, Los Angeles, Calif. 90028; George Spector, 233 Broadway RM 3815, New York City, N.Y. 10007

[21] Appl. No.: 521,842

[22] Filed: May 9, 1990

[51] Int. Cl.[5] ..... A63B 22/02

[52] U.S. Cl. ..... 272/69; 272/129; 434/247; 320/61

[58] Field of Search ..... 272/69, 70, 70.2, 70.3, 272/93, 96, 97, 100, 129, 130, 146, 115, 1 B, DIG. 9, 33 R, 33 A; 434/247, 253; 320/61.62

[56] References Cited

U.S. PATENT DOCUMENTS 2,838,022 6/1958 Wilson ..... 272/115 X
2,953,394 9/1960 Anderson ..... 272/115 X
3,536,324 10/1970 Ahrens ..... 272/69
3,537,726 11/1970 Conover ..... 272/1 R
3,622,179 11/1971 Pfersick ..... 272/1 R X
4,389,047 6/1983 Hall ..... 272/69

*Primary Examiner*—Richard J. Apley
*Assistant Examiner*—Joe H. Cheng
*Attorney, Agent, or Firm*—Robert J. Schaap

[57] ABSTRACT

A jogging-generator is provided and consists of a drum shaped exercise unit sized so that a jogger can run therein, an electric generator and a mechanism connected to the exercise unit for operating the generator during the running of the jogger to produce electrical current from the generator.

4 Claims, 1 Drawing Sheet

JOGGING GENERATOR

BACKGROUND OF THE INVENTION

The instant invention relates generally to electrical power sources and more specifically it relates to a jogging-generator which provides an electrical current from a generator when a person jogging rotates a mechanical hook-up to operate the generator.

There are available various convention electrical power sources which do not provide the novel improvements of the invention herein disclosed.

SUMMARY OF THE INVENTION

A primary object of the present invention is to provide a jogging-generator that will overcome the shortcomings of the prior art devices.

Another object is to provide a jogging-generator that will allow a person jogging to rotate a mechanical hook-up to a generator for operating the generator providing electrical current therefrom.

An additional object is to provide a jogging-generator in which the jogger can utilize the invention indoors or outdoors.

A further object is to provide a jogging-generator that is simple and easy to use.

A still further object is to provide a jogging-generator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the invention showing a person jogging in a rotating ring to operate a generator.

FIG. 1*a* is a diagrammatic view showing a house with access to an adjacent jogging-generator.

DETAILED DESCRIPTION OF THE PREFERRED EMBODIMENTS

Figure 1:
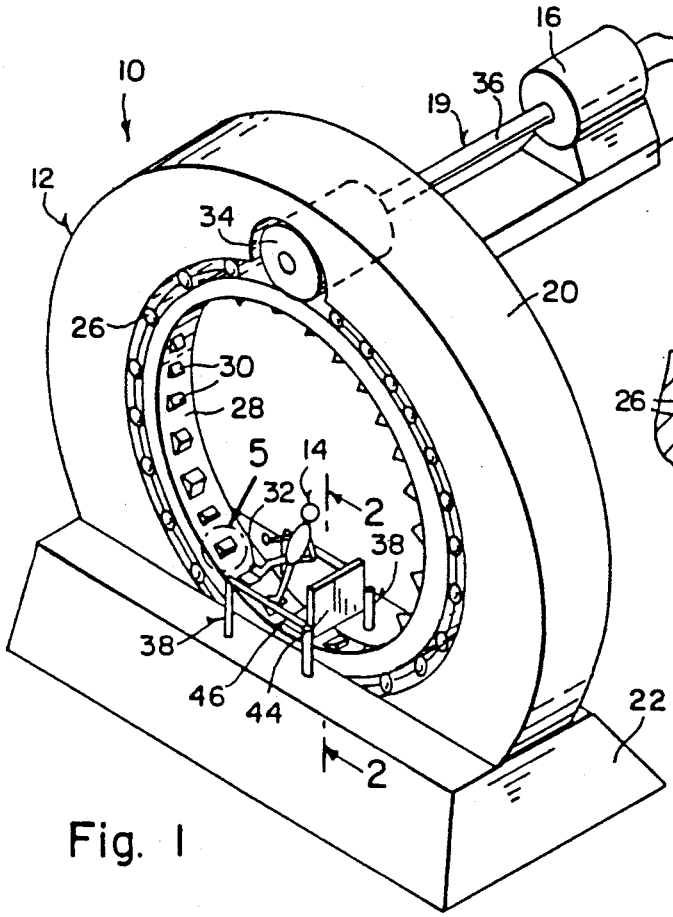
Figure 2:
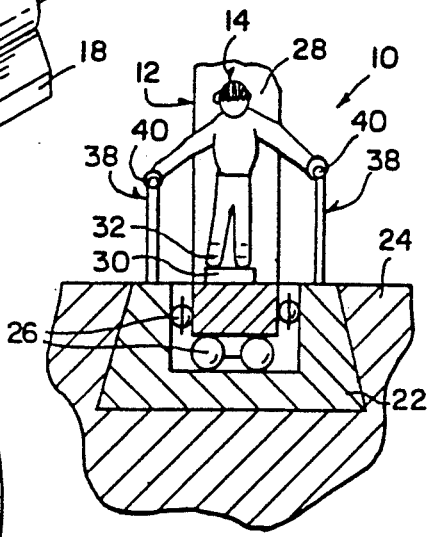
FIG. 2 is a cross sectional view taken along line 2—2 in FIG. 1, showing various details therein.
Figure 1A:
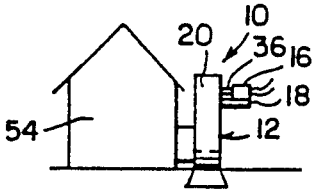

Turning now descriptively to the drawings, in which similar reference characters denote similar elements throughout the several views, FIGS. 1, 1*a* and 2 illustrate a jogging-generator 10 consisting of a drumshaped exercise unit 12 sized so that a jogger 14 can run therein. An electric generator 16 is supported on a platform 18 while a mechanism 19 is connected to the drum shaped exercise unit 12 for operating the generator 16 during the running of the jogger 14 within the exercise unit 12 so as to produce electrical current from the generator 16.

Figure 5:
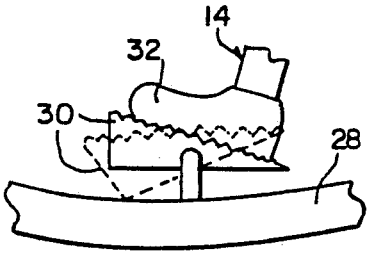
FIG. 5 is an enlarged side view as indicated by arrow 5 in FIG. 4, showing the joggers foot engaging a treaded step which is adjustable to provide a comfortable position for the foot.

The exercise unit 12 includes a drum housing 20 having a support foundation 22 to be placed into a flat surface 24, such as the ground or a floor. A ball bearing race 26 is carried within the drum housing 20 while a rotatable ring member 28 is carried on the ball bearing race 26. Adjustable treadles 30 (see FIG. 5) are spaced apart on the ring member 20 to provide a comfortable position for the foot 32 of the jogger 14.

The mechanism 19 includes a friction gear wheel 34 rotatable between the drum housing 20 and the ring member 28 located opposite the support foundation 22. An axle shaft 36 extends from the center of the friction gear wheel 34 to the generator 16. When the jogger 14 runs on the treadles 30 in the ring member 28 the axle shaft 36 will rotate to operate the generator 16.

Figure 3:
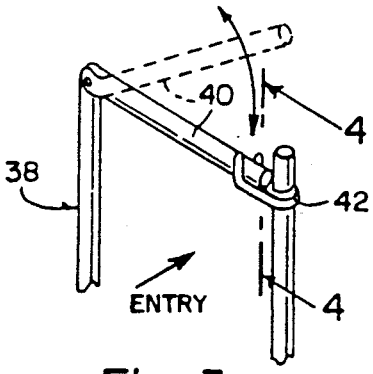
FIG. 3 is a perspective view of one of the side access gates and support bars for the jogger in greater detail.
Figure 4:
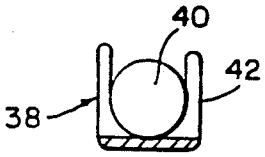
FIG. 4 is a cross sectional view taken along line 44 in FIG. 3, showing the bracket in greater detail.

A pair of access gates 38 are each positioned on each side of the drum housing 20 on the support foundation 22. As best seen in FIGS. 3 and 4, each gate 38 has a pivotable horizontal rail 40 which rests within a bracket 42 so that the jogger 14 can enter therethrough and hold onto both of the horizontal rails 40 when running in place. A seat 44 is provided and has a pair of foot rests. The seat 44 extends across the access gates 38 over the ring member 28 so that the jogger 14 can sit upon the seat 44 and place both feet 32 within the foot rests when not running.

Figure 6:
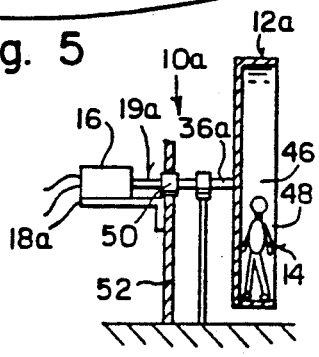
FIG. 6 is a side view of a modification showing the generator within a building and the large drum-shaped wheel for the jogger outdoors.

A modification 10*a* is shown in FIG. 6, in which the exercise unit 12*a* is a large drum wheel 46 having an open side 48 so that the jogger 14 can enter to run in place. The mechanism 19*a* is an axle shaft 36*a* which extends from the center of the drum wheel 46 to the generator 16 through a bearing 50 in a fixed partition 52, such as a wall of a building. When the jogger 14 runs in the large drum wheel 46 the axle shaft 36*a* will rotate to operate the generator 16. The generator 16 is supported on a platform 18*a* which is attached to the partition 52.

The jogging-generator 10 or 10*a* can be designed for either indoor or outdoor installation and can be disassembled for use in different seasons.

Optionally the invention can have an old mill wheel decor added to the exterior of the exercise unit 12 or 12*a* to blend in with the decor of a building 54 (see FIG. 1*a*) on an outside installation.

An outdoor lighting display can be connected to the electric current while an optional motor can be attached to the ring member 28 or to the gear wheel 34. The invention can also be fabricated out of transparent plastic material to prevent it from looking like a huge power plant.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A jogging-generator for use by a person to jog therein and generate an electrical current during a jogging activity, said jogging-generator comprising:

a) support means, b) a drum shaped exercise unit housing supported by said support means and sized so that a jogger can run therein;

c) bearing means associated within said drum shaped exercise unit housing;

d) rotatable ring member operatively supported by said bearing means for rotation within said drum shaped exercise unit housing;

e) an electrical generator;

f) means connected to said drum shaped exercise unit housing for operating said generator during the running of the jogger within said drum shaped exercise unit housing so as to produce electrical current from said generator; and g) a foot receiving section on said rotatable ring member to receive and provide a comfortable position for the feet of the jogger, said foot receiving section being spaced around the entire circumference of said rotatable ring member.

2. A jogging generator as received in claim 1, wherein said support means is a support foundation to be placed onto a flat surface.

3. A jogging-generator as recited in claim 2, wherein said means connected to said drum shaped exercise unit housing for operating said generator comprises:

a) a friction gear wheel rotatable between said drum shaped exercise unit housing and said rotatable ring member, said friction gear being located opposite said support foundation; and b) an axle shaft extending from a center of said friction gear wheel to said generator so that when the jogger runs on said foot receiving section in said rotatable ring member said axle shaft will rotate to operate said generator.

4. A jogging-generator as recited in claim 3, further comprises:

a) a pair of access gates each positioned on each side of said drum shaped exercise unit housing on said support foundation, each said gate having a pivotable horizontal rail which rests within a bracket so that the jogger can enter therethrough and hold onto both of said horizontal rails when running in place; and b) a seat which extends across said access gates over said rotatable ring member so that the jogger can sit upon said seat when not running.

* * * * *